United States Patent [19]

Randall

[11] Patent Number: 4,624,073

[45] Date of Patent: Nov. 25, 1986

[54] LOCKING TILT WINDOW SASH AND LOCK THEREFOR

[75] Inventor: Robert P. Randall, Pittsburgh, Pa.

[73] Assignee: Traco, Warrendale, Pa.

[21] Appl. No.: 798,384

[22] Filed: Nov. 15, 1985

[51] Int. Cl.[4] ..... E05D 15/22

[52] U.S. Cl. ..... 49/161; 49/175; 49/185; 292/164

[58] Field of Search ..... 49/161, 181, 185, 175, 49/257, 255; 292/175, 163, 164, DIG. 33

[56] References Cited

U.S. PATENT DOCUMENTS

| | | | |
|---|---|---|---|
| 655,382 | 8/1900 | Talbot | 49/185 |
| 4,144,674 | 3/1979 | Dovman | 49/181 X |
| 4,525,952 | 7/1985 | Cunningham et al. | 49/181 X |

*Primary Examiner*—Philip C. Kannan

*Attorney, Agent, or Firm*—Carothers & Carothers

[57] ABSTRACT

A tilting window sash having a lock pin intermediate the ends of the vertical stiles which supports perpendicular loads to prevent inward bowing of the sash and which automatically releases upon normal lifting and/or tilting of the sash.

17 Claims, 5 Drawing Figures

LOCKING TILT WINDOW SASH AND LOCK THEREFOR

BACKGROUND OF THE INVENTION

In the Art of both residential and commercial window units it is well known to provide tilting window sashes of various constructions. For example, modern single or double-hung windows often include at least one vertically slidable sash which has pivots located at the opposite lateral sides of the sash adjacent to the bottom of the frame stiles and selectively releasable latches located at the opposite lateral sides of the sash adjacent to the top of the respective stiles.

In normal operation, the latches and pivots typically will cooperate with vertical slide channels or tracks in the window jamb to retain the tilting sash for vertical sliding whereby the window is opened and closed. Upon selective release of the upper latches, the sash may be tilted inwardly about the pivots to accommodate cleaning of the exterior glazing surface from within the building.

Various factors including the steadily increasing cost of building maintenance and heightened concern for worker safety have contributed to the demand for such tilting window units. In spite of such demand, however, tilting windows have been subject to certain shortcomings in some instances. For example, modern building codes and architect's specifications, especially for commercial high-rise buildngs, often require the building windows to withstand very large lateral loads without distortion. This has come about in part as a result of increased awareness of the impact a structure like a high-rise office tower can have on such environmental factors as prevailing winds. Indeed, research has clearly demonstrated that the presence of an office tower of given proportions in an air stream can quite readily double the wind velocity of the air passing around the structure, thus resulting in the generation of highly turbulant and forceful air flows and eddies from what would otherwise be merely a gentle breeze. An air flow of such violence can impose loads perpendicular to the exterior glazing surface of up to 50 or 60 pounds per square foot or more on the windows of any building located in the air flow path. In recognition of this phenomenon, window specifications, especially for towers in crowded metropolitan areas, often call for sashes which will withstand 50, 60 or even 100 pounds per square foot of perpendicular force without inward bowing of the window sash stiles or other distortion of the window frame. Any significant inward bowing of the sash stiles would cause loss of seal integrity and result in drafts and water leakage.

Tilt windows in particular have exhibited problems in this regard as the frame of a tilting sash generally cannot be captured by the window jamb along its entire length to be thereby secured against inward bowing without also being incapable of inward tilting. Furthermore, manually operated latches intermediate the ends of the tilting sash stiles, although offering the prospect for sufficient anti-bowing support to satisfy applicable load bearing criteria, have often been objectionable to architects who seek windows with a clean interior finish.

BRIEF SUMMARY OF THE INVENTION

The present invention contemplates a tilting window sash which incorporates in each of its stiles a spring loaded locking pin or latch which is operable to permit the sash to be raised vertically for opening to provide fresh air ventilation, or to be tilted inwardly for cleaning. The locking pin operates automatically in response to sash raising or tilting to permit these functions without need of any separate manipulation of the lock. Additionally, the lock is automatically effective as a positive anti-bowing restraint when the sash is closed. Accordingly, the locking pins are carried by the window sash stiles for cooperation with the window jamb to provide anti-bowing support at points preferably about midway between the ends of the respective stiles.

More particularly, the invention contemplates a spring loaded, generally rectangular elongated locking pin having a generally pyramidal jamb engagement portion which cooperates with a cutout formed in the jamb to provide the above described functions. The locking pin is retained with a recess in the stile which may be a channel section of an elongated extrusion, by a clip which defines a housing for the locking pin.

Accordingly, one object of this invention is to provide a novel and improved tilting and vertically slidable window sash which includes an anti-bowing lock to automatically engage the window jamb in a manner to support the sash against inward bowing loads when the sash is closed.

Another object of the invention is to provide a novel and improved locking mechanism which automatically affords anti-bowing support for the stiles of a tilting, vertically slidable window sash while also automatically accommodating the tilting and vertical sliding of the sash.

These and other objects and advantages of the invention will be more fully understood upon consideration of the following detailed description and the accompanying drawings in which.

Figure 1:
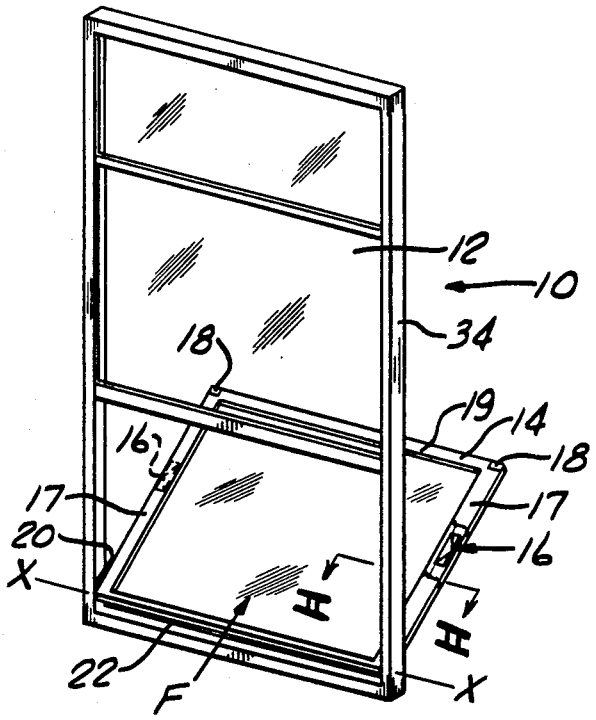
FIG. 1 is a perspective view of a tilting window sash according to the present invention.

There is generally indicated at 10 in FIG. 1 a single hung window unit according to one presently preferred embodiment of the instant invention and shown as including a fixed sash 12 and a vertically slidable tilting sash 14 which incorporates anti-bow locks 16 in each of the vertical stiles 17 of the sash frame 19. Although a single hung window is shown, it will be appreciated that the invention is applicable in any window having a vertically slidable and tiltable sash, whether of a single or double hung configuration, or of other suitable design. Furthermore, it will be appreciated that in theory the invention is applicable not only to a window unit having a frame constructed of aluminum extrusions as shown, but additionally to windows with wood, vinyl or other suitable frame structures.

As shown, sash 14 includes selectively operable top latches 18 which may be actuated from the interior side of sash 14 to release the sash for inward tilting thereof about pivots 20 located adjacent the lower ends of sash 14 on pivot axis X—X. As shown at 22, sash 14 typically is initially raised vertically by a desired amount to permit the sash to clear the interior sill and/or trim of the window upon tilting thereof.

When sash 14 is latched in its vertical or non-tilted orientation, it is secured at the top and bottom against perpendicular loads such as indicated at F by latches 18 and pivots 20, respectively. In addition, a lock 16 is operative intermediate each respective latch and pivot pair 18, 20 to support the sash 14 against inward bowing of stiles 17 which would otherwise result under sufficient loading F with only the corners of sash 14 secured as described.

Referring now to FIGS. 2–5, anti-bow lock 16 comprises an elongated locking pin member 24 which is interfitted with an elongated, curved backup leaf spring 26 by means of converging end tabs 27 of spring 26 that are received in cooperable slots 29 formed in pin member 24. The pin 24 and spring 26 are received within a recess defined within channel section 28 of the stile 17 such that a formed actuating surface portion 30 of the pin 24 projects outwardly of the stile 17 to cooperate with a cutout 32 formed in an adjacent portion of the window jamb 34.

Figure 2:
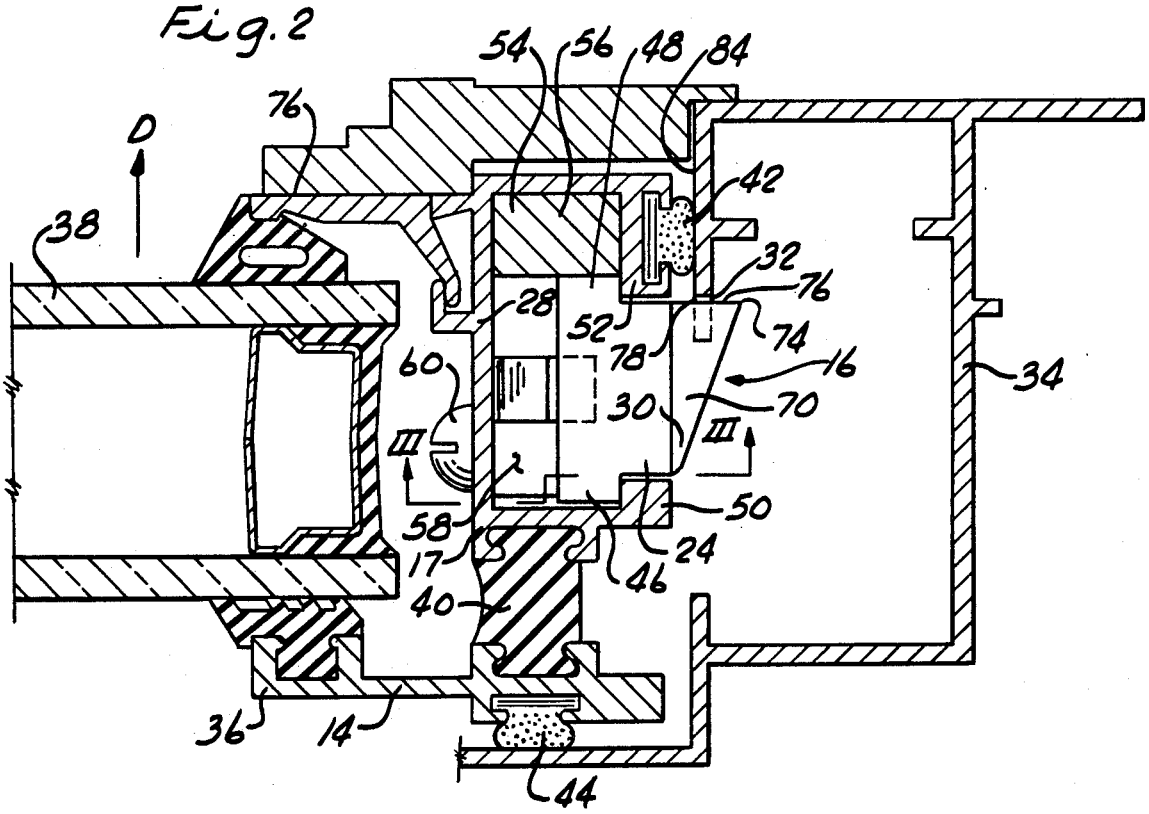
FIG. 2 is a sectional view taken on line II—II of FIG. 1 and showing the locking mechanism of the invention.
Figure 3:
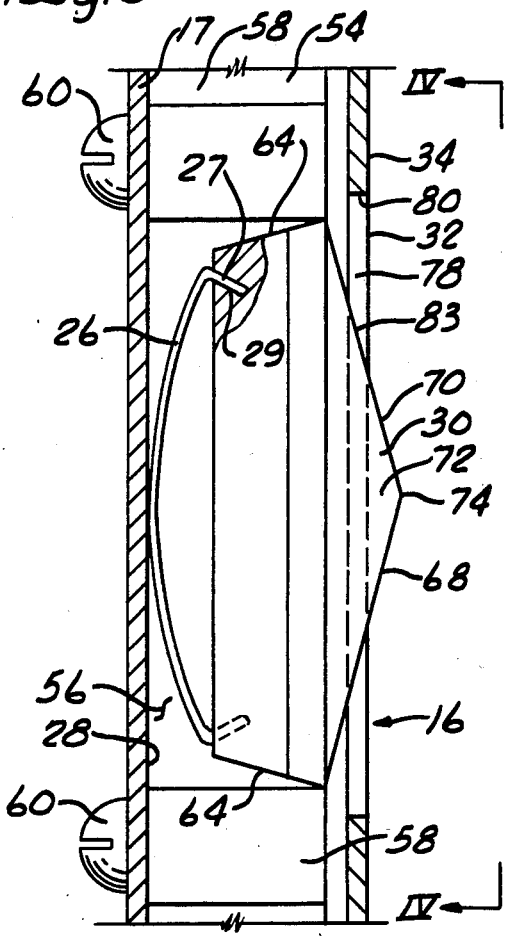
FIG. 3 is a fragmentary section taken on line III—III of FIG. 2.
Figure 4:
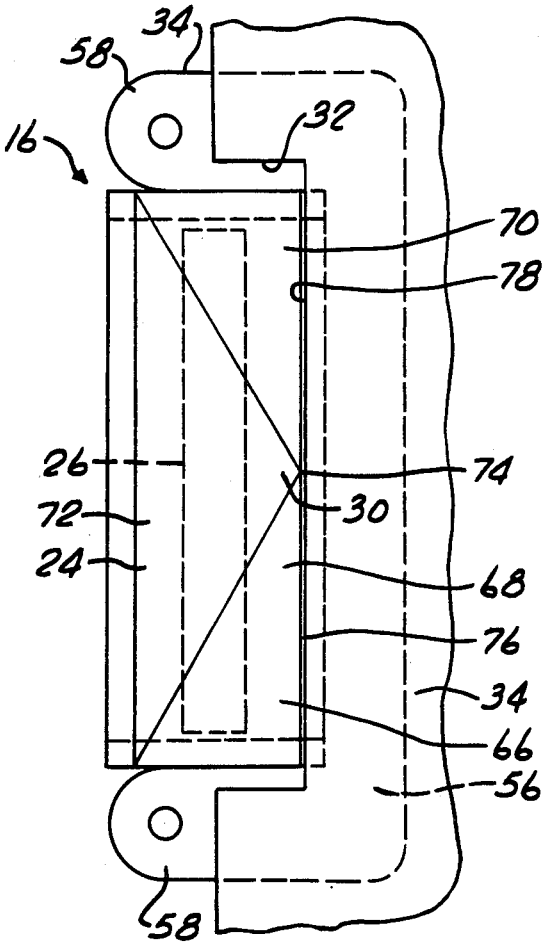
FIG. 4 is a fragmentary elevation taken on lines IV—IV of FIG. 3.
Figure 5:
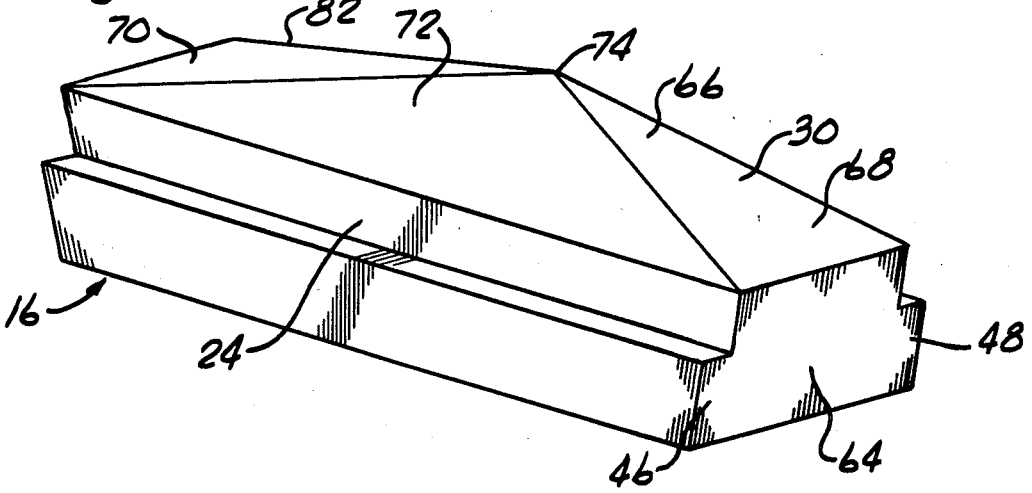
FIG. 5 is a perspective view of the locking pin element of the invention.

The window illustrated is an aluminum window in which the jamb 34 is an aluminum extrusion and the sash frame, including stile 17, is comprised of an assembly of extruded members having lip or flange portions 36 that form a channel to receive glazing 38. The sash frame also incorporates other such conventional features as a thermal barrier 40 and perimeter seals 42, 44. These structural features are merely typical of modern tilt windows, although in particular seals 42 and 44 are cooperable with jamb 34 to provide a double seal when the window is closed, and to permit vertical sliding and inward tilting of the sash 14. In this latter regard, seal 42 provides for sliding engagement and disengagement upon tilting of sash 14 in the direction D as shown in FIG. 2, while seal 44 provides a face seal with jamb 34 that parts upon inward tilting of sash 14. As shown, lock 16 is located intermediate seals 42 and 44 and inside of thermal barrier 40.

Locking pin 24 is retained within channel 28 by lateral projections 46, 48 thereof which are captured beneath respective overlapping projections 50, 52 of channel section 28. The actuating and locking surface portion 30 of pin 24 projects outwardly of channel section 28 between projections 50 and 52 to cooperate with surfaces of cutout 32 and other portions of jamb 34 as will be described hereinbelow. In its normal locked configuration, pin 24 is biased outwardly from channel section 28 by spring 26 to an extreme outer position defined by engagement of the cooperating projections 46, 48 with respective projections 50, 52, as shown in FIG. 2. The lock 16 is actuated by overcoming the outward bias of spring 26 to move the pin 24 inwardly of channel section 28 as hereinbelow described.

The assembly of pin 24 and spring 26 is retained in a predetermined position within channel section 28 by a generally C-shaped clip 54 which includes a longitudinal portion 56 that extends intermediate a pair of laterally projecting end legs 58. Longitudinal portion 56 positions pin 24 laterally within channel section 26 while end legs 58 enclose the ends of pin 24 whereby the clip 54 defines a recess within the stile member 17 into which the locking pin 24 is received. Thus, by securing clip 54 at a predetermined location within channel section 28, such as by suitable fasteners 60 (e.g. screws or rivets) the pin and spring assembly may be captively retained at a position to extend into cutout 32. Fasteners 60 will conveniently engage clip legs 58 via apertures 62 formed therein.

With the spring and pin assembly retained as described, the pin 24 is free to rock longitudinally in response to actuating forces applied thereto. To accommodate such rocking, the opposite longitudinal ends 64 of pin 24 are undercut to avoid binding thereof against the end legs 58 of clip 54.

The actuating surface portion 30 of pin 24 includes a formed, outwardly facing surface 66 having three sloping surface portions 68, 70 and 72 which diverge from a common apex 74. Apex 74 is located at an intermediate point on the outermost edge of a locking surface portion 76 of pin 24 which faces inwardly of the window plane or toward the direction D. The described sloped actuating surfaces and the locking surface 76 cooperate with cutout 32 and other portions of jamb 34 as follows. In the normal closed configuration of sash 14, locking pin 24 is biased by spring 26 to its extreme outer position where locking surface 76 engages an adjacent logitudinal surface 78 of cutout 32 to support the midportion of stile 17 under perpendicular loads F such as wind loads and the like.

To release locking pin 24 for window opening, the sash 14 is lifted as usual, whereupon the upper lateral end 80 of cutout 32 engages sloping surface 70 of locking pin 24 and urges pin 24 back into channel section 28 against the bias of spring 26. The sash 14 thus may be opened and closed with the ease and convenience of similar conventional windows and without any separate manipulation of the anti-bow lock.

To tilt the sash 14 inwardly, the sash preferably may be raised vertically as above described until apex 74 passes lateral end 80 of cutout 32. At this point, locking surface 76 is fully disengaged from the mating surface 78 of cutout 32 and the sash 14 thus may be tilted inwardly at pivots 20. Since conventional tilt windows often require the tilting sash to be lifted before tilting in order to clear the interior sill and/or trim, the sash 14 may thus be tilted with the same ease and convenience as available in similar conventional windows. Additionally, however, this invention contemplates that the engagement of cutout surface 78 with the sloping vertex or intersection between lock pin surfaces 70 and 76 (as shown at 83 in FIG. 3) may upon initial tilting motion of the sash develop a sufficient force component directed toward the stile 17 to move locking pin 24 inwardly against the bias of spring 26 such that vertical lifting of the sash would not necessarily be required prior to tilting motion to disengage locking pin 24. To achieve this effect, the window assembly may have to accommodate a degree of initial free play to establish at least a minimal angle of actuation between surfaces 78 and 76. This would result from a first small increment of tilting motion for example. The longitudinal rocking capability of locking pin 24 is also considered to be an important factor in permitting initial tilting impetus and motion to override the locking capability of lock 16 and force locking pin 24 into its recess within stile 17 against the bias of spring 26.

Upon closing of the tilted-open sash 14, inner surface 84 of jamb 34 engages locking pin actuating surface 72 to guide the locking pin inwardly into channel section 28 and thereby clear jamb surface 84. Upon return of the sash to the fully closed condition, apex 74 of locking pin 24 overrides the edge of cutout 32 and is released, and pin 24 moves under spring bias to its outermost position with surfaces 76 and 78 again in locking engagement.

According to the description hereinabove, the present invention provides a novel and improved automatic lock which supports the stiles of a tilting window against the bowing forces of vertical loads such as wind or the like, without interferring in any way with the usual sash lifting and tilting functions and without requiring separate manual operation of additional lock mechanisms. Of course, the inventor has contemplated various alternative and modified embodiments apart from the described embodiment of the invention. Accordingly, it is intended that the invention be construed broadly and limited only by the scope of the claims appended hereto.

I claim:

1. In a window unit having at least one tilt window sash which is vertically slidable with respect to the window jamb to open and closed positions, said sash comprisng:

a frame including a pair of laterally spaced, vertically coextensive stiles;

pivot means adjacent the bottom of each respective stile to support said sash for vertical sliding and for tilting with respect to said jamb;

latch means adjacent the top of each respective stile to support said sash for vertical sliding with respect to said jamb, said latch means being selectively releasable to permit tilting of said sash about said pivot means;

lock means carried by the respective said stiles longitudinally intermediate the respective said pivot means and said latch means;

said lock means being engageable in interlocking engagement with the window jamb when said sash is closed to support said stiles with respect to said jamb under force components directed generally perpendicularly to said sash; and said lock means being operable in response to initial movement of said sash to disengage from said jamb and permit tilting of said sash, and to re-engage said jamb in locking engagement therewith in response to return of said sash to its closed position.

2. The window sash as claimed in claim 1 wherein said initial movement includes initial vertical sliding movement of said sash with respect to said jamb.

3. The window sash as claimed in claim 1 wherein said initial movement includes initial tilting movement of said sash with respect to said jamb.

4. The window sash as claimed in claim 1 wherein said locking means includes at least one locking pin and a spring means for biasing said locking pin laterally outwardly of the respective said stile into engagement with respective portions of the window jamb.

5. The window sash as claimed in claim 4 wherein said locking pin includes a generally pyramidal locking portion which projects laterally outwardly of the respective said stile.

6. The window sash as claimed in claim 5 wherein said pyramidal portion includes a first sloped surface portion engageable with said jamb to provide impetus for overcoming said bias and moving each said locking pin laterally inwardly of the respective said stile in response to said initial movement to thereby disengage said locking pins from said jamb.

7. The window sash as claimed in claim 6 wherein said pyramidal portion additionally includes a second sloped surface portion engageable with said jamb as said sash is moved from a tilted to a non-tilted configuration to provide impetus for overcoming said bias and moving said locking pin laterally inwardly of the respective said stile whereby said locking pin overrides said jamb and is reengageable with said jamb in locking engagement therewith as said sash reaches its non-tilted configuration.

8. The window sash as claimed in claim 7 wherein said bias means is cooperable with said locking pin to permit longitudinal rocking motion of said locking pin with respect to the respective said stile.

9. The window sash as claimed in claim 8 wherein said at least one locking pin is a pair of locking pins, with one of said locking pins being received in each said stile of said sash.

10. An automaticallly operable lock for providing selective locking engagement between a stile of a tilting, vertically movable window sash and a window jamb comprising:

an elongated clip adapted to be received by such a stile to define therein an open ended recess extending laterally into such stile away from such window jamb;

an elongated locking pin received within said recess and including a portion which projects toward such window jamb;

a spring bias means which is operable to bias said locking pin outwardly of said recess to maintan said portion thereof in position for locking engagement with such window jamb;

said portion of said locking pin including a locking surface portion for locking engagement with such jamb, a first actuator surface portion which is cooperable with such window jamb in response to initial tilting or vertical movement of such sash to overcome the bias of said spring and thereby release said locking engagement, and a second actuator surface portion which is cooperable with said jamb in response to movement of such sash from a tilted to a non-tilted orientation to overcome the bias of said spring and thereby permit said locking pin to re-engage such jamb for locking engagement therewith when such sash is closed.

11. The lock as claimed in claim 10 wherein said spring bias means includes an elongated curved leaf spring which engages said locking pin adjacent its longitudinal ends.

12. The lock as claimed in claim 11 wherein said locking pin includes undercut longitudinal ends to permit longitudinal rocking motion thereof during movement of said locking pin inwardly and outwardly with respect to said recess.

13. The lock as claimed in claim 12 wherein said first actuator surface portion includes at least one outwardly facing surface portion which extends longitudinally of said locking pin ends and slopes from a central apex thereof inwardly toward said recess.

14. The lock as claimed in claim 13 wherein said second actuator surface portion includes an outwardly facing surface portion which slopes laterally from said apex toward said recess.

15. The lock as claimed in claim 14 wherein said locking surface portion includes a surface extending from said apex toward said recess and having a common vertex with said first actuator surface portion.

16. The lock as claimed in claim 15 wherein said second actuator surface portion includes a common vertex with said first actuator surface portion.

17. The lock as claimed in claim 16 wherein said locking surface portion and said first and second actuator surface portions share said apex in common and mutually intersect in a manner that all of the vertices between said locking surface, said first actuator surface portion and said second actuator surface portion extend radially from said apex and slope inwardly toward said recess.

* * * * *